United States Patent [19]

Pietryka

[11] 4,323,107

[45] Apr. 6, 1982

[54] CONTINUOUS CASTING INSTALLATION

[75] Inventor: Joseph Pietryka, Paris, France

[73] Assignee: Fives-Cail Babcock, Paris, France

[21] Appl. No.: 75,975

[22] Filed: Sep. 17, 1979

Related U.S. Application Data

[63] Continuation of Ser. No. 914,440, Jun. 12, 1978, abandoned.

[51] Int. Cl.[3] ..... B22D 11/04; B22D 11/12

[52] U.S. Cl. ..... 164/416; 164/441

[58] Field of Search ..... 164/82, 83, 416, 441, 164/442, 447, 448

[56] References Cited

U.S. PATENT DOCUMENTS

| | | | |
|---|---|---|---|
| 3,437,129 | 4/1969 | Black, Jr. | 164/416 |
| 3,542,117 | 11/1970 | Lemper | 164/83 |
| 3,779,303 | 12/1973 | Pietryka | 164/416 |

*Primary Examiner*—Robert D. Baldwin

*Assistant Examiner*—K. Y. Lin

*Attorney, Agent, or Firm*—Kurt Kelman

[57] ABSTRACT

An installation for continuously casting steel billets comprises a support structure and a guiding roll-rack for the cast billets receiving molten steel from an oscillatory mold and comprising an upper and lower section each having a frame. The upper section and the mold constitute a demountable and replaceable unit. The upper section is supported on the top of the lower section and carries a support for guiding the mold for oscillation. The lower section is mounted on the support structure and carries a mechanism for oscillating the mold. This mechanism comprises an arm mounted for pivoting on the top of the lower guiding device section frame, an actuating rod connecting the arm to the mold for oscillating the mold is response to the pivoting of the arm, and respective pivots connecting the actuating rod to the arm and to the mold, one of the pivots being readily detachable.

10 Claims, 4 Drawing Figures

CONTINUOUS CASTING INSTALLATION

This is a continuation of my copending patent application Ser. No. 914,440, filed June 12, 1978, now abandoned.

The present invention relates to an installation for casting molten ferrous metal into a continuous strand, such as a steel billet, which comprises a support structure, an oscillatory mold receiving the molten ferrous metal and discharging the continuous metal strand, and a guiding device arranged to receive the continuous metal strand from the mold and guiding the strand until the molten metal has solidified, the guiding device being comprised of an upper section including a frame and a lower section including a frame having a top adjacent the upper guiding device section frame.

The guiding device in such casting installations usually is comprised of a roll-rack holding two substantially parallel rows of guide rolls wherebetween the cast metal strand passes. The guide rolls may be replaced by guide plates or grids immediately below the mold.

In installations of this type, the spacing between the guide rolls may be adjusted to permit the production of billets of different gauge but the guide elements in the upper section immediately below the mold has no means for adjusting their spacing because this zone of the guiding device is not readily accessible and the temperatures in this zone are so extreme that adjustment means mounted there deteriorate rapidly. Therefore, the upper section of the guiding device is detachably mounted and is removed with the mold when it is desired to change the spacing between the guide elements there to produce billets of different gauges. This detachable mounting of the upper guiding device section is also necessary for replacing the guide rolls or plates which deteriorate more rapidly in this zone than elsewhere in the installation. In these installations, the mold is removably mounted on an oscillating table.

In certain conventional continuous metal casting installations, the different parts of the guiding device and of the oscillating table carrying the mold are individually mounted on a support structure. In these installations, it is very difficult, if not impossible, to maintain the alignment of the various parts of the guiding device and of the mold because of the different thermal expansion coefficients.

It has also been proposed to hinge the upper guiding device section to the frame of the lower guiding device section. But in such an installation, the oscillating table for the mold is supported independently of the guiding device. Although means is provided for aligning the mold with the upper guiding device section, proper alignment cannot be maintained when the support structure carrying the mold and the guiding device housing are subjected to variations in temperature. To remedy this, the oscillating table and the upper guiding device section have been mounted on an extension of the frame of the lower guiding device section. The extension may be constituted by a casing in which the upper guiding device section is positioned and on which the oscillating table rests, and this section may be moved into and out of the casing.

It is the primary object of this invention to simplify the structure of continuous casting installations of the first indicated type and, more particularly, to constitute the upper guiding device and the mold as a demountable and replaceable unit separate from the oscillating means for the mold which remains in the installation during replacement of the unit. With such an independent oscillating means, handling of the unit by a hoist during replacement is greatly facilitated whereby the upper guiding device section and the mold may be rapidly disassembled and replaced.

The above and other objects and advantages are accomplished according to the invention with an upper guiding device section frame supported on, and affixed to, the top of the lower guiding device frame. The upper guiding device section frame carries means for supporting and guiding the mold for oscillation, and the lower guiding device section frame is mounted on the support structure of the installation. The lower guiding device section frame carries means for oscillating the mold and the oscillating means comprises an arm mounted for pivoting on the top of the lower guiding device frame, an actuating rod connecting the arm to the mold for oscillating the mold in response to the pivoting of the arm, and respective pivoting means connecting the actuating rod to the arm and to the mold, one of the pivoting means being readily detachable. The upper guiding device section and the mold constitute a demountable and replaceable unit.

The above and other features of this invention will become more apparent from the following detailed description of certain now preferred embodiments thereof, taken in conjunction with the accompanying schematic drawing wherein FIG. 1 is a side elevational view showing the mold, the upper guiding device section and the top of the lower guiding device section of one embodiment of a continuous casting installation according to the invention;

Figure 1:
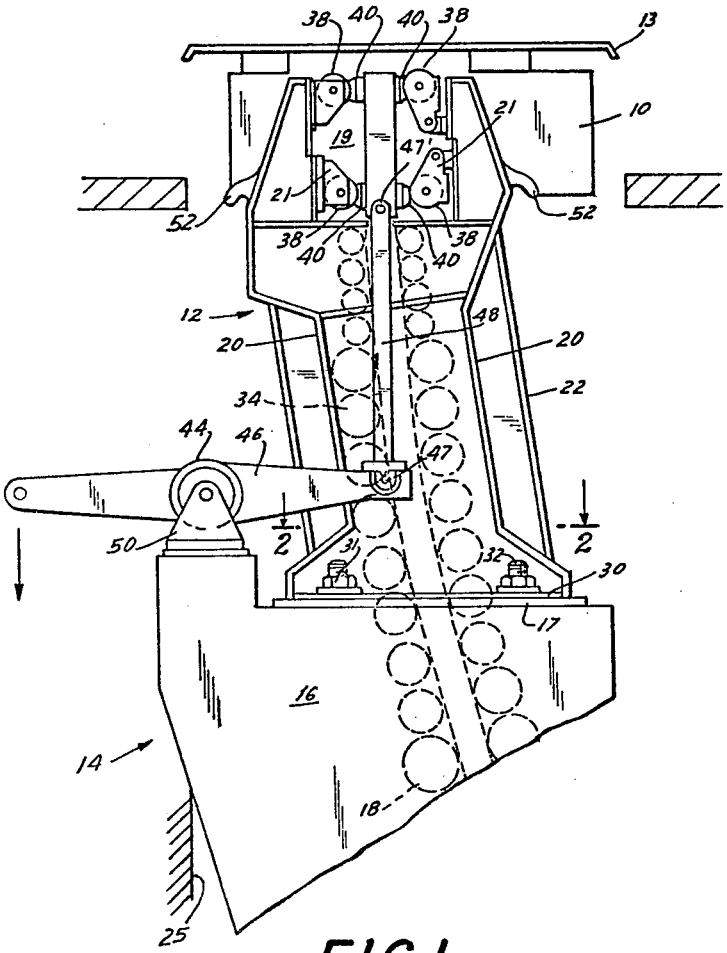
Figure 2:
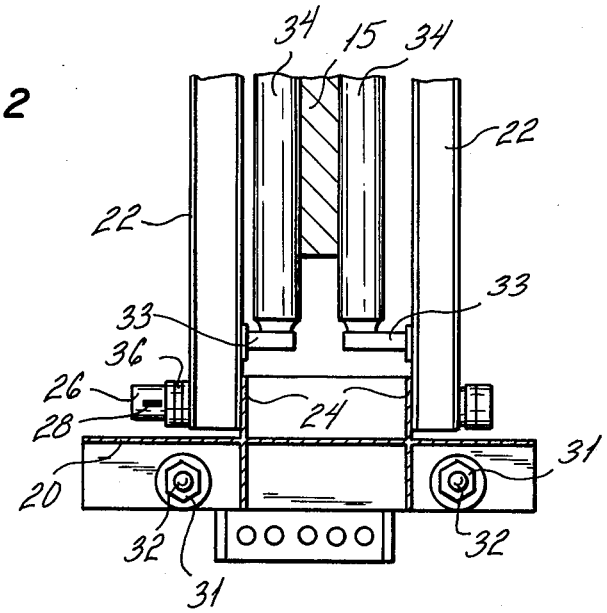
FIG. 2 is a section along line 2—2 of FIG. 1, showing one half of the guiding device section.

Referring now to the drawing and first to FIGS. 1 and 2, there is schematically shown that portion of an installation for casting molten ferrous metal into a continuous strand embodying the present invention, which comprises oscillatory mold 10 receiving molten ferrous metal 11 through a suitably shaped port in mold cover 13 and discharging continuous metal strand 15. A guiding device constituted in the illustrated embodiment by a guiding roll-rack is arranged to receive the continuous metal strand from mold 10 and to guide the strand through a curvilinear path in which the metal strand is cool and solidified. The guiding device is comprised of upper section 12 and lower section 14, the lower guiding device section including frame 16 having top 17 adjacent upper guiding device section 12. Upper roll-rack section 12 is positioned immediately below mold 10 and is relatively short, guiding metal strand 15 towards arcuate lower roll-rack section 14 which guides the strand to a horizontally extending path, all in a conventional manner. Generally, the lower roll-rack section is sub-divided into several parts. This lower roll-rack section includes curvilinear frame 16 supported on a suitable support structure 25 constituted by a suitable foundation and carrying a series of juxtaposed guide rolls 18 extending in two substantially parallel rows defining therebetween a passage for the cast metal strand. Various forms of roll-racks and guide roll mountings are known and any suitable form may be used in combination with this invention.

In accordance with the invention, upper roll-rack section 12 includes a frame comprising two side plates 20 supported on and affixed to the lower roll-rack section 14. In the illustrated embodiment, the side plates have flanges 30 at their base and these flanges rest on support surfaces at top 17 of frame 16, the flanges being affixed to the support surfaces by readily detachable means, such as illustrated bolts 32 which may be held in position by nuts 31. Crossbeams 22 interconnect and brace side plates 20 of the upper roll-rack, and guide rolls 34 for the continuous metal strand are carried by the crossbeams. As shown in FIG. 2, guide rolls 34 are journaled in bearings 33 mounted on crossbeams 22. The side plates have inwardly projecting ribs 24 (see FIG. 2) to which respective ends of crossbeams 22 are affixed by means of axles 26. Wedges 36 may be removably mounted on the axles to adjust the spacing between crossbeams 22 and, thus, between guide rolls 34 mounted thereon, the assembly being held together by cotter pin 28 passing through a slot at one end of axles.

As illustrated in FIG. 1, the two side plates 20 of the frame of upper roll-rack section 12 define U-shaped notches 19 at the upper ends thereof. Means constituted in the illustrated embodiment by guide rollers 38 are carried on side plates 20 for supporting and guiding the mold 10 for oscillations therebetween, guide rollers 38 being carried on brackets 21 projecting from the side plates into notches 19. The guide rollers cooperate with guides 40 fixed directly to the mold housing and so oriented as to provide a mold oscillation in a predetermined trajectory, straight or curvilinear, depending on the type of oscillatory mold and installation. Obviously, if desired, the guides may be fixed to the side plates and the guide rollers to the mold housing to obtain an equivalent structure and operation.

The illustrated installation also comprises means for oscillating mold 10 and the illustrated oscillating means comprises shaft 44, bearings 50 for the ends of the shaft, arm 46 mounted on the shaft for pivoting therewith, and respective pivoting means 47 and 47' connecting actuating push rod 48 to arm 46 and to the housing of mold 10 for oscillating the mold in response to pivoting of the arm shaft 44 may be pivotal and arm 46 keyed thereto for pivoting therewith, or shaft 44 may be fixed and arm 46 may be pivotally mounted thereon. Pivot 47 is readily detachable for disconnecting rod 48 from arm 46. When it is desired to remove the structural unit comprised of mold 10 and upper guiding device section 12 from the lower guiding device section, pivot connection 47 is detached, leaving the remainder of the oscillating mechanism in place on frame 16.

Contrary to conventional continuous casting installations with oscillatory molds, the illustrated installation has no oscillatory table supporting the mold, and the means for supporting and guiding the mold for oscillation, such as guide rollers 38, cooperate directly with the mold housing, and the support means and oscillation control means act directly on the mold.

In the embodiment of FIG. 1, bearings 50 for the oscillating means are mounted on the top of the lower guiding device section frame 16, and mold 10, together with the upper guiding device section, constitute a demountable and replaceable structural unit, after push rod 48 has been disconnected.

Figure 3:
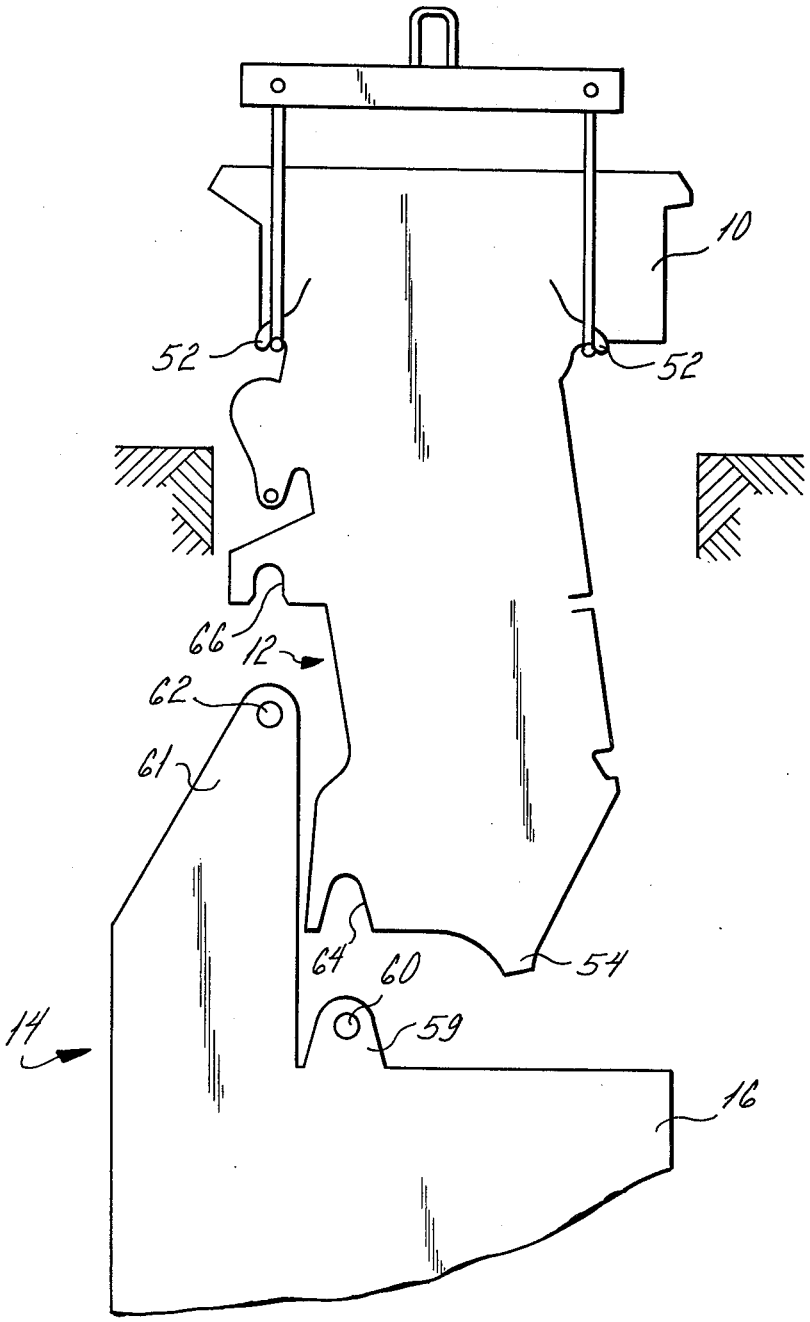
FIG. 3 is a diagrammatic side view showing the structural unit of an upper guiding device section and mold being placed in position on the lower guiding device section by a hoist.

In the embodiment of FIG. 3, upper roll-rack section 12 is mounted on lower roll-rack section 14 by means of two horizontal axles 60 and 62 carried by lower section frame 16, axles 60 projecting from small brackets 59 on frame 16 while axles 62 project from elongated brackets 61 extending upwardly from frame 16 so that support axles 60 and 62 are positioned on two levels. Side plates 20 of the frame of upper roll-rack section 12 define notches 64 and 66 sized to receive axles 60 and 62 so that the structural unit may be replaced on the lower roll-rack section by seating notches 64 and 66 on axles 60 and 62.

Figure 4:
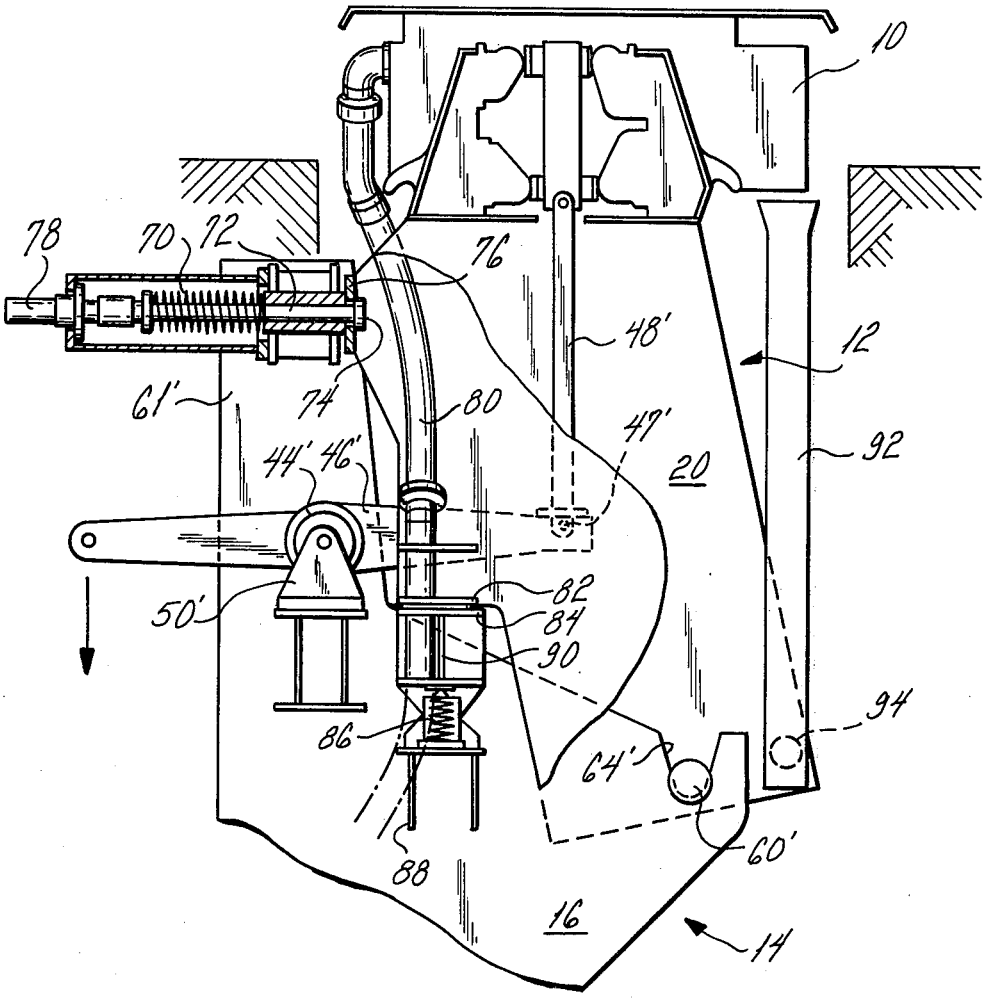
FIG. 4 illustrates another embodiment of the installation, partly in side elevation and partly in section.

In the embodiment of FIG. 4, like reference numerals designate like parts functioning in a like manner to avoid redundancy in the description. This figure shows the cooling water conduits for delivering cooling water to the mold and to the guiding device sections as well as detachable attachment means for section 12, part of one of the side plates 20 and one of the walls of frame 16 being cut away to show the cooling fluid arrangement and attachment means while the guide rolls are omitted for sake of clarity of illustration.

In this embodiment, the arrangement of support axles 60' and notches 64' is reversed from that shown in FIG. 3, i.e. the support axles project from side plates 20 while the notches are defined in the side walls of frame 16 so that axles 60' descend into notches 64' when the frame of upper guiding device section 12, with mold 10, is lowered onto frame 16. At a higher level, the frame of section 12 is affixed to frame 16 of the lower guiding device section by means of a resilient mechanism mounted on top of frame 16.

The resilient attaching mechanism illustrated in FIG. 4 is constituted by calibrated spring 70 biasing rod 72 equipped with head 74 into seat 76 mounted on section 12. The spring-biased rod is mounted on elongate bracket 61' extending upwardly from frame 16 and seat 76 has a reverse U shape to receive rod head 74. Spring 70 is calibrated to exert sufficient pressure to hold section 12 immobile on frame 16 during normal operation of the installation. If abnormal forces are exerted upon guiding device section 12, for example in the case of solidification of the casting due to a machine stoppage, section 12 may pivot about axles 60' against the bias of spring 70. Jack 78 permits spring 70 to be so adjusted as to enable the unit 10–12 to be disassembled rapidly, the attachment of upper section 12 to lower section 14 being disengaged by removing rod head 74 from seat 76.

FIG. 4 also shows the cooling water conduits for mold 10 and upper guiding device section 12 as well as a joint for the water conduit permitting rapid dismantling of the installation and replacement of unit 10–12.

The cooling water conduits are represented in the drawing by conduit 80 delivering cooling water to mold 10. The joint for the water conduit comprises a pair of tubular plates 82 and 84 to which conduits 80 are connected of which one is shown. Upper tubular plate 82 is affixed to upper guiding device section 12 and lower tubular plate 84 is connected to frame 16 of lower guiding device section 14 by means of resilient means, such as illustrated spring 86. Spring 86 is mounted on bracket 88 on frame 16 and biases beam 90 supporting tubular plate 84 against tubular plate 82. When unit 10–12 is emplaced, spring 86 is compressed, holding tubular plates 82 and 84 in sealing engagement to provide a water-tight joint. Suitable abutments limit the upward movement of spring-biased beam 90 when unit 10–12 is removed from frame 16.

It will be appreciate that, in any of the described and illustrated embodiments, structural unit 10–12 may be disassembled, replaced and assembled very rapidly and with a minimum of effort. In the embodiment of FIG. 4, it is only necessary to operate jack 78 to detach rod head 74 from seat 76 and to remove pivot connection 47' between push rod 48' and arm 46', assembly being equally easy by the reverse operation. The water joint is sealed automatically and requires no special attention.

FIG. 4 also shows a vertical guide 92 cooperating with roller 94 at the base of upper guiding device section 12 to provide guide means for section 12 when it is lifted and lowered, one such guide and roller being provided at each side of section 12. Such guide means will facilitate placing structural unit 10–12 in position.

While the present invention has been described and illustrated in connection with certain now preferred embodiments thereof, it will be understood that many modifications and variations may occur to those skilled in the art without departing from the spirit and scope of this invention as defined in the appended claims and that, in particular, the guiding device as well as the oscillating mechanism for the mold may take any suitable form compatible with the installation herein described and claimed.

What is claimed is:

1. An installation for casting molten ferrous metal into a continuous strand, which comprises a support structure, an oscillatory mold receiving the molten ferrous metal and discharging the continuous strand, and a guiding device arranged to receive the continuous strand from the mold and to guide the strand, the guiding device being comprised of an upper section including a frame and a lower section including a frame having a top adjacent the upper guiding device section frame, wherein (a) the upper guiding device section frame is supported on, and affixed to, the top of the lower guiding device section frame, (b) the upper guiding device section frame carries means for supporting and guiding the mold for oscillation, (c) the lower guiding device section frame is mounted on the support structure of the installation, (d) the lower guiding device section frame carries means for oscillating the mold, the oscillating means comprising (1) an arm mounted for pivoting on the top of the lower guiding device section frame and remote from the mold, (2) an actuating rod connecting the arm to the mold for oscillating the mold in response to the pivoting of the arm, and (3) respective pivoting means connecting the actuating rod to the arm and to the mold, one of the pivoting means being readily detachable, and (e) the upper guiding device section and the mold constitute a demountable and replaceable unit.

2. The casting installation of claim 1, wherein the oscillating means further comprises a shaft and bearing means on the lower guiding device section frame for mounting the shaft, the arm being mounted on the shaft for pivoting.

3. The casting installation of claim 1 or 2, wherein the means for supporting and guiding the mold comprises guide rollers wherebetween the mold is supported and guided for oscillation and guide means for the guide rollers.

4. The casting installation of claim 1 or 2, wherein the upper guiding device section frame includes (a) two side plates, (b) crossbeams interconnecting and bracing the side plates, and (c) guide rolls for the continuous strand, the guide rollers being carried by the crossbeams.

5. The casting installation of claim 4, further comprising ears on the side plates permitting the demountable and replaceable structural unit to be hooked onto a hoisting means.

6. The casting installation of claim 5, further comprising cooperating centering means on the upper and lower guiding device section frames.

7. The casting installation of claim 1, further comprising means for removably and rigidly affixing the side plates of the upper guiding device section frame to the top of the lower guiding device section housing.

8. The casting installation of claim 7, wherein the affixing means comprises axles projecting from the frame at two levels and cooperating notches in the side plates for receiving the axles.

9. The casting installation of claim 7, wherein the affixing means comprises axles projecting from the side plates at one level and cooperating with notches in the top of the lower guiding device section frame whereby the upper guiding device section is capable of pivoting about the axles, and a resilient attaching means between the frame and the side plates at a higher level whereby the upper guiding device section frame may be pivoted about the axles against the bias of the resilient attaching means, the attaching means being detachable.

10. The casting installation of claim 1, further comprising cooling water conduits arranged to cool the mold and the upper guiding device section and, for each of the conduits, a joint comprised of a pair of tubular plates to which the conduits are connected, an upper one of the tubular plates being affixed to the upper guiding section frame and a lower one of the tubular plates being connected to the lower guiding section frame, and a resilient means holding the tubular plates in sealing engagement to provide a water-tight joint when the upper guiding device section frame is supported on and affixed to the top of the lower guiding device section frame.

* * * * *